US006831545B2

(12) United States Patent
Karbula

(10) Patent No.: US 6,831,545 B2
(45) Date of Patent: Dec. 14, 2004

(54) E-I OR E-E TRANSFORMER

(75) Inventor: Jiri Karbula, Riehen (CH)

(73) Assignee: Endress + Hauser Flowtec AG, Reinach (CH)

( * ) Notice: Subject to any disclaimer, the term of this patent is extended or adjusted under 35 U.S.C. 154(b) by 0 days.

(21) Appl. No.: 10/179,029

(22) Filed: Jun. 26, 2002

(65) Prior Publication Data

US 2002/0196121 A1 Dec. 26, 2002

Related U.S. Application Data

(60) Provisional application No. 60/314,629, filed on Aug. 27, 2001.

(30) Foreign Application Priority Data

Jun. 26, 2001 (EP) ..... 01115366

(51) Int. Cl.[7] ..... H01F 27/24
(52) U.S. Cl. ..... 336/212; 336/5
(58) Field of Search ..... 336/212, 182, 336/5, 214, 215, 220–222, 178

(56) References Cited

U.S. PATENT DOCUMENTS 3,188,552 A * 6/1965 Owen
3,667,034 A * 5/1972 Freeze ..... 324/547
3,914,652 A 10/1975 Valkestijn
3,990,030 A * 11/1976 Chamberlin ..... 336/65
4,766,365 A * 8/1988 Bolduc et al. ..... 323/308
5,315,279 A * 5/1994 Ito et al. ..... 336/178
5,731,666 A * 3/1998 Folker et al. ..... 315/276
5,760,669 A 6/1998 Dangler et al.
5,889,373 A * 3/1999 Fisher et al. ..... 315/307
6,348,848 B1 * 2/2002 Herbert ..... 336/178
6,611,190 B2 * 8/2003 Chui et al. ..... 336/198

FOREIGN PATENT DOCUMENTS

DE 4124509 A1 1/1993

* cited by examiner

*Primary Examiner*—Anh Mai
(74) *Attorney, Agent, or Firm*—Bacon & Thomas

(57) ABSTRACT

With the E-I or E-E transformer, signals which are independent of each other are to be transferable simultaneously, without the signals interfering with each other. The E-I transformer has an E core (e, E'), which has two outer legs (ES1, ES2) and an inner leg (EM), and a yoke (1) which combines with the E core to form a double closed magnetic circuit. A first coil and a second coil are wound around the inner leg (EM), and a third coil and a fourth coil are wound around one (ES1) of the outer legs. The E-E transformer has a first E core (E1, E1') and an identical second E core (E2, E2'); each E core has two outer legs (ES11, ES21, ES11', ES21'; ES12, ES22, ES12', ES22') and an inner leg (EM1, EM1'; EM2, EM2'); the E cores together form a double closed magnetic circuit and two outer links (ST1, ST1', ST2, ST2') as well as an inner link (STM, STM'). A first coil and a second coil are wound around the inner link, and a third coil and a fourth coil are wound around the outer link ST1, ST1'). The coils on each leg or link may be wound side by side or one above another. The coils on the inner leg or link and those on the outer leg or link form part of different AC power transmission paths.

22 Claims, 3 Drawing Sheets

E-I OR E-E TRANSFORMER

This application claims the benefit of provisional application No. 60/314,629, filed Aug. 27, 2001.

FIELD OF THE INVENTION

This invention relates to E-I and E-E transformers.

BACKGROUND OF THE INVENTION

The magnetic circuit of an E-I transformer commonly comprises a ferromagnetic E core, which has two outer legs and an inner leg, and a ferromagnetic yoke in the form of a straight bar, the E core and the yoke being so arranged that a doubly closed magnetic circuit is obtained.

The magnetic circuit of an E-E transformer commonly comprises a first ferromagnetic E core, which has two outer legs and an inner leg, and a second ferromagnetic E core, which is identical to the first E core and also has two outer legs and an inner leg, the two E cores being so arranged that a doubly closed magnetic circuit is obtained. The respective two outer legs then form two outer links, and the two inner legs form an inner link.

The aforementioned magnetic circuits become electric power transformers if at least two coils, each of which is placed on one of the outer legs or outer links, or one of which is placed on an outer leg or outer link and the other on the inner leg or inner link, or both of which are placed on an outer leg or outer link or on the inner leg or inner link, interact with the magnetic circuit.

Such transformers serve to provide isolation between primary and secondary circuits for, e.g., AC signals, DC/DC converters, etc. So far, a special transformer has been used for each of these applications.

SUMMARY OF THE INVENTION

It is an object of the invention to design E-I transformers and E-E transformers in such a manner that signals which are independent of each other can be transferred simultaneously, without the signals interfering with each other. To attain this object, a first variant of the invention consists in an E-I transformer comprising

- a ferromagnetic E core, having a first and a second outer leg and an inner leg,
- a ferromagnetic yoke in the form of a straight bar which is so arranged that it and the E core form a doubly closed magnetic circuit,
- a first coil, wound around the inner leg,
- a second coil, wound around the inner leg,
- a third coil, wound around the first outer leg, and
- a fourth coil, wound around the first outer leg.

To attain the above object, a second variant of the invention consists in an E-E transformer comprising

- a first ferromagnetic E core, which has a first and a second outer leg and a first inner leg,
- a second ferromagnetic E core, which is identical to the first E core, has a third and a fourth outer leg and a second inner leg, and is so arranged
  - that it and the first E core form a doubly closed magnetic circuit
  - which has a first outer link, a second outer link, and an inner link,
- a first coil, wound around the inner link,
- a second coil, wound around the inner link,

- a third coil, wound around the first outer link, and
- a fourth coil, wound around the first outer link.

In a first preferred embodiment of each of the two variants of the invention, the first coil is placed beside the second coil.

In a second preferred embodiment of the invention, which can also be used with the first preferred embodiment, the third coil is placed beside the fourth coil.

In a third preferred embodiment of the invention, which can also be used with the first and second preferred embodiments, the first coil and the second coil are, respectively, a primary coil and a secondary coil of a first AC power transmission path, and the third coil and the fourth coil are, respectively, a primary coil and a secondary coil of a second AC power transmission path.

According to a further development of the third preferred embodiment of the invention, the frequency of the first AC power is substantially less than the frequency of the second AC power, with the first coil and the second coil preferably being a primary coil and a secondary coil, respectively, of a DC/DC converter, and the third coil and the fourth coil serving to accomplish an electrically separated transfer of digital signals.

In another preferred embodiment of the invention, a transformer according to any one of the above-mentioned embodiments is used in a physical-to-electrical transducer with on-board evaluation electronics.

In a further preferred embodiment of the invention, the transformer is used in a physical-to-electrical transducer with on-board evaluation electronics, with the third coil having an external two-wire field bus connected thereto, and the fourth coil interacting with a digital circuit of the on-board evaluation electronics.

One advantage of the invention is that one and the same transformer can be used for two different functions, which saves material and space. The space saving is of particular importance if at the locations of the transformers, only little space is available for electronic components; that is frequently the case with industrial measuring devices, because the forms of their housings are generally standardized.

BRIEF DESCRIPTION OF THE DRAWINGS

The invention and further advantages will now be explained in greater detail with reference to the accompanying drawings, in which.

DETAILED DESCRIPTION OF THE PREFERRED EMBODIMENTS

Figure 1:
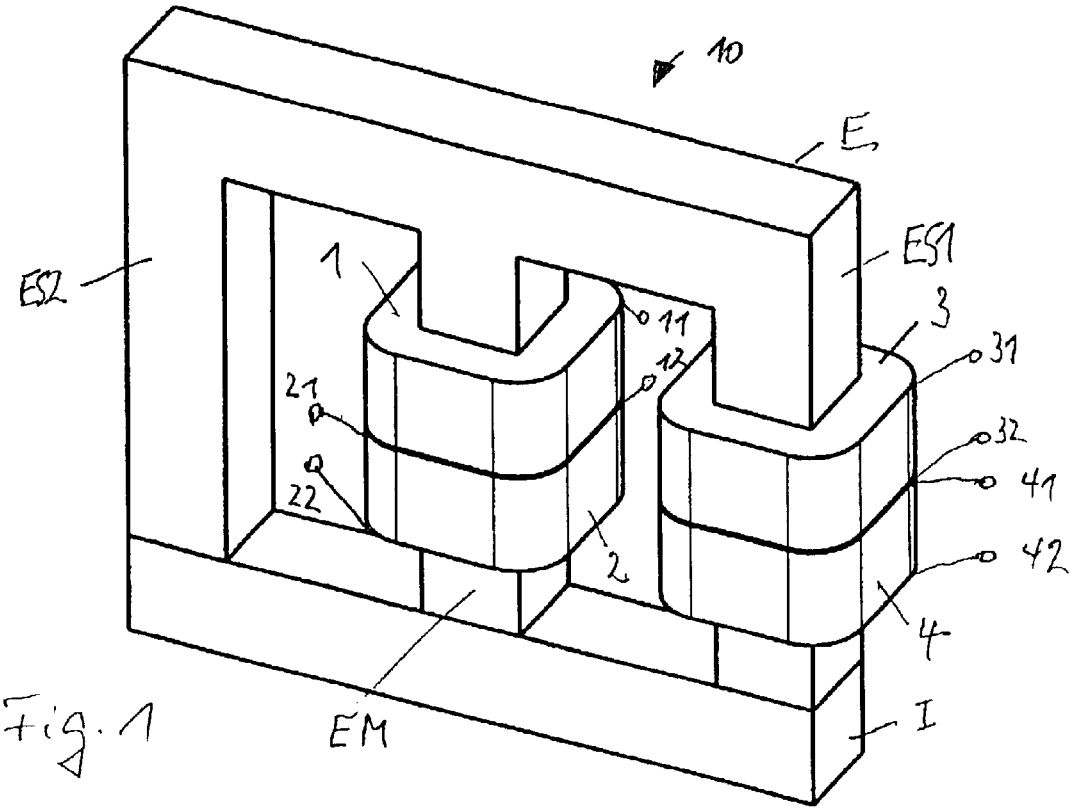
FIG. 1 is a schematic and perspective view of a first embodiment of an E-I transformer with two coils arranged side by side on the inner leg and two coils arranged side by side on one of the outer legs.

FIG. 1 shows schematically and in perspective a first embodiment of an E-I transformer. An E-I transformer 10 has a ferromagnetic E-core E and a ferromagnetic yoke I in the form of a straight bar. The E core E has a first outer leg ES1 and a second outer leg ES2 as well as an inner leg EM. E core E and yoke I are so arranged that two closed magnetic circuits are obtained.

The first magnetic circuit comprises the outer leg ES1, the portion of yoke I connecting the outer leg ES1 with the inner leg EM, the inner leg EM, and the portion of E core E connecting the inner leg EM with the outer leg ES1. The second magnetic circuit comprises the outer leg ES2, the portion of yoke I connecting the outer leg ES2 with the inner leg EM, the inner leg EM, and the portion of E core E connecting the inner leg EM with the outer leg ES2.

E-I transformer 10 has a first coil 1 wound around inner leg EM, a second coil 2 wound around inner leg EM, a third coil 3 wound around outer leg ES1, and a fourth coil 4 wound around outer leg ES1. Coil 1 has terminals 11, 12, coil 2 has terminals 21, 22, coil 3 has terminals 31, 32, and coil 4 has terminals 41, 42. In FIG. 1, coils 1 and 2 on inner leg EM are arranged side by side, preferably in close proximity to each other.

Figure 2:
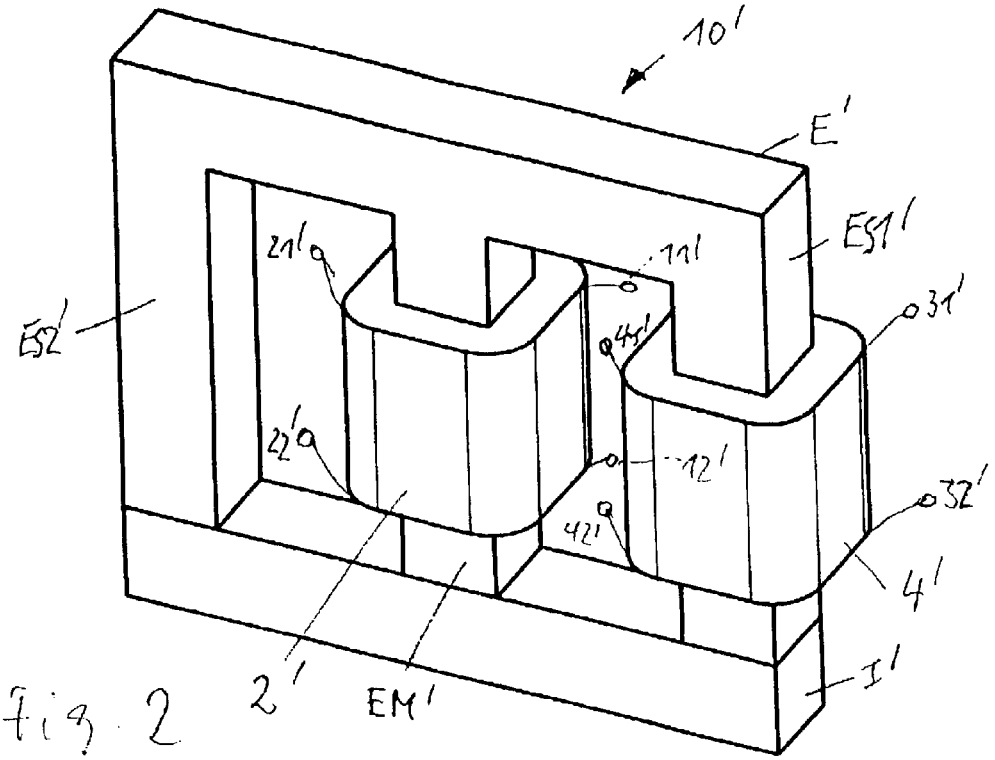
FIG. 2 is a schematic and perspective view of a second embodiment of an E-I transformer with two coils wound one over another on the inner leg and two coils wound one over another on one of the outer legs.

FIG. 2 shows schematically and in perspective a second embodiment of an E-I transformer. An E-I transformer 10' has a ferromagnetic E core E' and a ferromagnetic yoke I' in the form of a straight bar. E core E' has a first outer leg ES1' and a second outer leg ES2' as well as an inner leg EM'. E core E' and yoke I' are so arranged that two closed magnetic circuits are obtained.

The first magnetic circuit comprises the outer leg ES1', the portion of yoke I' connecting the outer leg ES1' with the inner leg EM', the inner leg EM', and the portion of E core E' connecting the inner leg EM' with the outer leg ES1'. The second magnetic circuit comprises the outer leg ES2', the portion of yoke I' connecting the outer leg ES2' with the inner leg EM', the inner leg EM', and the portion of E core E' connecting the inner leg EM' with the outer leg ES2'.

E-I transformer 10' has a first coil wound around inner leg EM', a second coil 2' wound around inner leg EM' and over the first coil, a third coil wound around outer leg ES1', and a fourth coil 4' wound around outer leg ES1' and over the first coil. Since the first and third coils are covered, they cannot be seen in FIG. 2. The first coil has terminals 11', 12', coil 2' has terminals 21', 22', the third coil has terminals 31', 32', and coil 4' has terminals 41', 42'.

Figure 3:
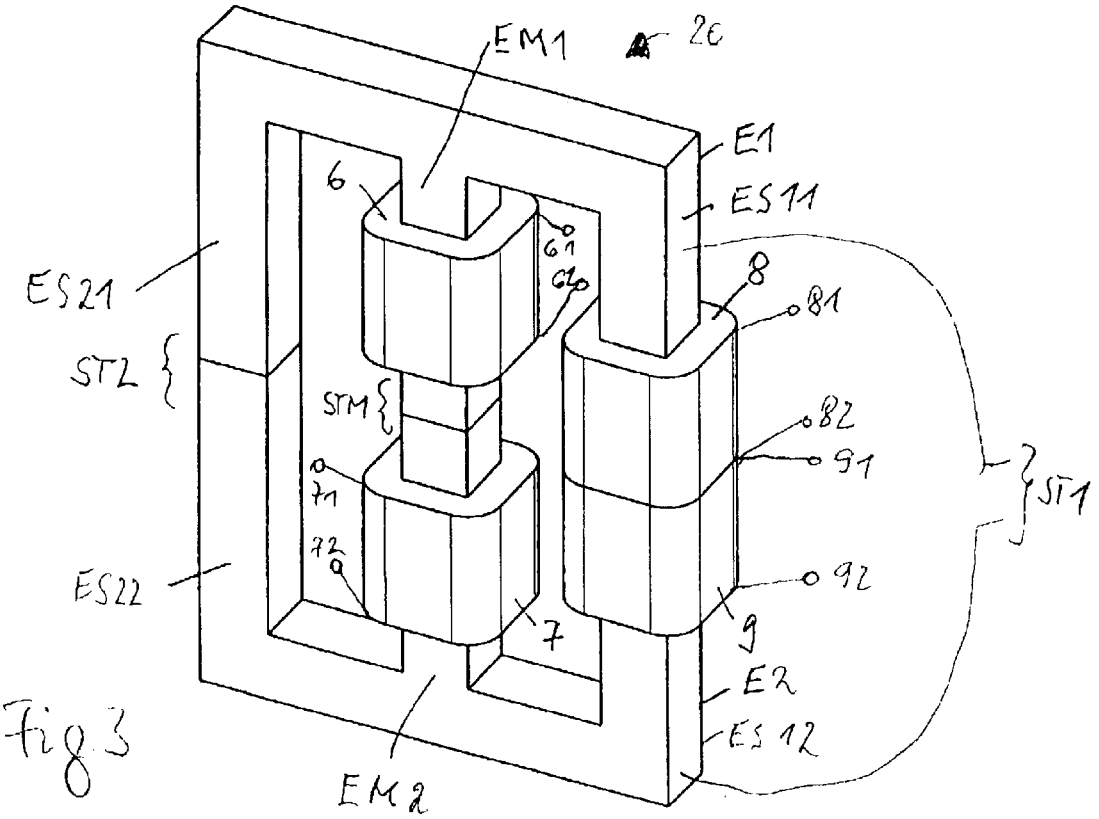
FIG. 3 is a schematic and perspective view of a first embodiment of an E-E transformer with two coils arranged side by side on the inner link and two coils arranged side by side on one of the outer links.

FIG. 3 shows schematically and in perspective a first embodiment of an E-E transformer. An E-E transformer 20 has a first ferromagnetic E core E1 and a second ferromagnetic E core E2. E core E1 has a first outer leg ES11 and a second outer leg ES12 as well as an inner leg EM1. E core E2 has a first outer leg ES21 and a second outer leg ES22 as well as an inner leg EM2. The two E cores E1, E2 are so arranged that two closed magnetic circuits are obtained.

The first magnetic circuit comprises the outer leg ES11, the outer leg ES12, the portion of E core E2 connecting the outer leg ES12 with the inner leg EM2, the inner leg EM2, the inner leg EM1, and the portion of E core E1 connecting the inner leg EM1 with the outer leg ES11.

The second magnetic circuit comprises the outer leg ES21, the outer leg ES22, the portion of E core E2 connecting the outer leg ES22 with the inner leg EM2, the inner leg EM2, the inner leg EM1, and the portion of E core E1 connecting the inner leg EM1 with the outer leg ES21.

In the assembled condition, outer legs ES11, ES12 form a first outer link ST1, outer legs ES21, ES22 form a second outer link ST2, and inner legs EM1, EM2 form an inner link STM.

E-E transformer 20 has a first coil 6 wound around inner link STM, a second coil 7 wound around inner link STM, a third coil 8 wound around outer link ST1, and a fourth coil 9 wound around outer link ST1. Coil 6 has terminals 61, 62, coil 7 has terminals 71, 72, coil 8 has terminals 81, 82, and coil 9 has terminals 91, 92.

In FIG. 3, coils 8, 9 on outer link ST1 are arranged side by side, preferably in close proximity to each other. Coils 6, 7 on inner link STM are arranged side by side but spaced a selectable distance apart; however, they may also be arranged in close proximity to each other like coils 8, 9.

Figure 4:
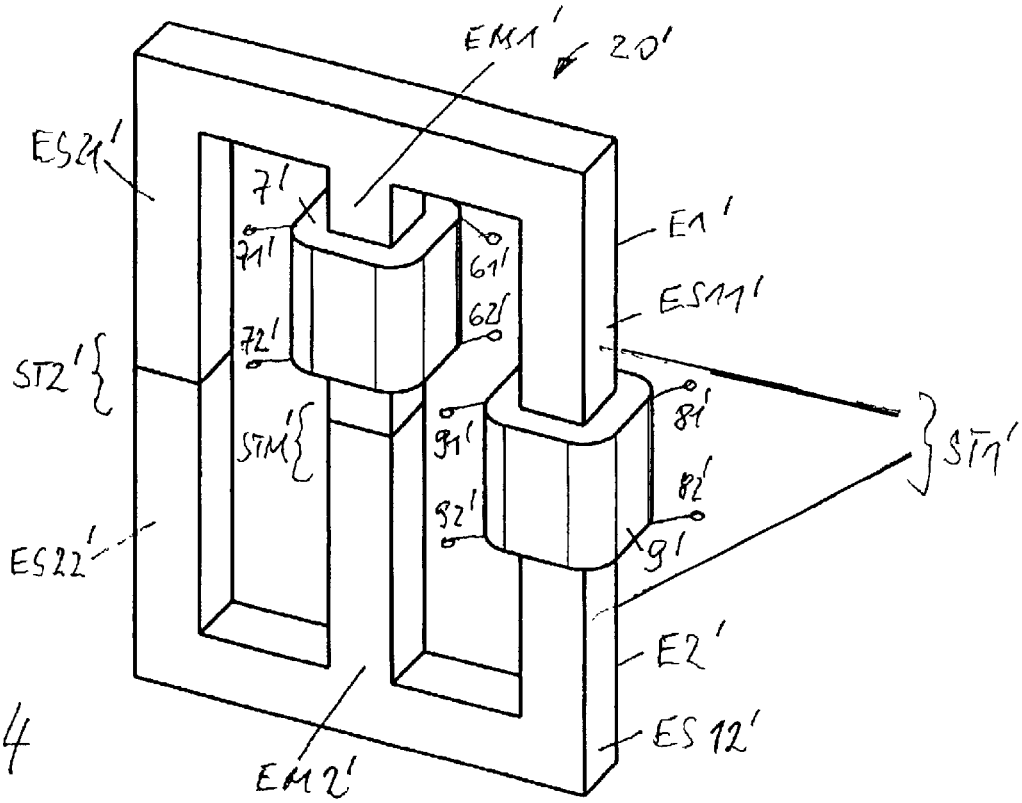
FIG. 4 is a schematic and perspective view of a second embodiment of an E-E transformer with two coils wound one over another on the inner link and two coils wound one over another on one of the outer links.

FIG. 4 shows schematically and in perspective a second embodiment of an E-E transformer. An E-E transformer 20' has a first ferromagnetic E core E1' and a second ferromagnetic E core E2'. E core E1' has a first outer leg ES11' and a second outer leg ES21' as well as an inner leg EM1'. E core E2' has a first outer leg ES12' and a second outer leg ES22' as well as an inner leg EM2'. The two E cores E1', E2' are so arranged that two closed magnetic circuits are obtained.

The first magnetic circuit comprises the outer leg ES11', the outer leg ES12', the portion of E core E2' which connects the outer leg ES12' with the inner leg EM2', the inner leg EM2', the inner leg EM1', and the portion of E core E1' which connects the inner leg EM1' with the outer leg ES11'.

The second magnetic circuit comprises the outer leg ES21', the outer leg ES22', the portion of E core E2' which connects the outer leg ES22' with the inner leg EM2', the inner leg EM2', the inner leg EM1', and the portion of E core E1' which connects the inner leg EM1' with the outer leg ES21'.

In the assembled condition, outer legs ES11', ES12' form a first outer link ST1', outer legs ES21', ES22' form a second outer link ST2', and inner legs EM1', EM2' form an inner link STM'.

E-E transformer 20' has a first coil wound around inner link STM', a second coil 7' wound over the first coil, a third coil wound over outer link ST1', and a fourth coil 9' wound over the third coil. The first coil has terminals 61', 62', the second coil 7' has terminals 71', 72', the third coil has terminals 81', 82', and the fourth coil 9' has terminals 91', 92'.

In FIG. 4, the coils on outer link ST1' are located approximately in the middle of the link, while the coils on inner link STM' are placed on inner leg EM1'; any other position on the inner and outer links are also possible.

In the embodiments of FIGS. 1 to 4, E core E, E', yoke I, I', and the two E cores E1, E2, E1', E2' may be laminations of ferromagnetic steel sheets or corresponding ferrite components, for example. For simplicity, the respective coils in the embodiment of FIGS. 1 to 4 are shown as air-core coils, i.e., as coils without a coil form. It is also possible, of course, to wind individual coils or all of the coils onto suitable coil forms and then place them on the legs or links.

It is also possible to place two separate coils on one of the legs or links as in FIG. 1 or 3, while two coils wound one over another are placed on the associated leg or link as in FIG. 2 or 4.

Figure 5:
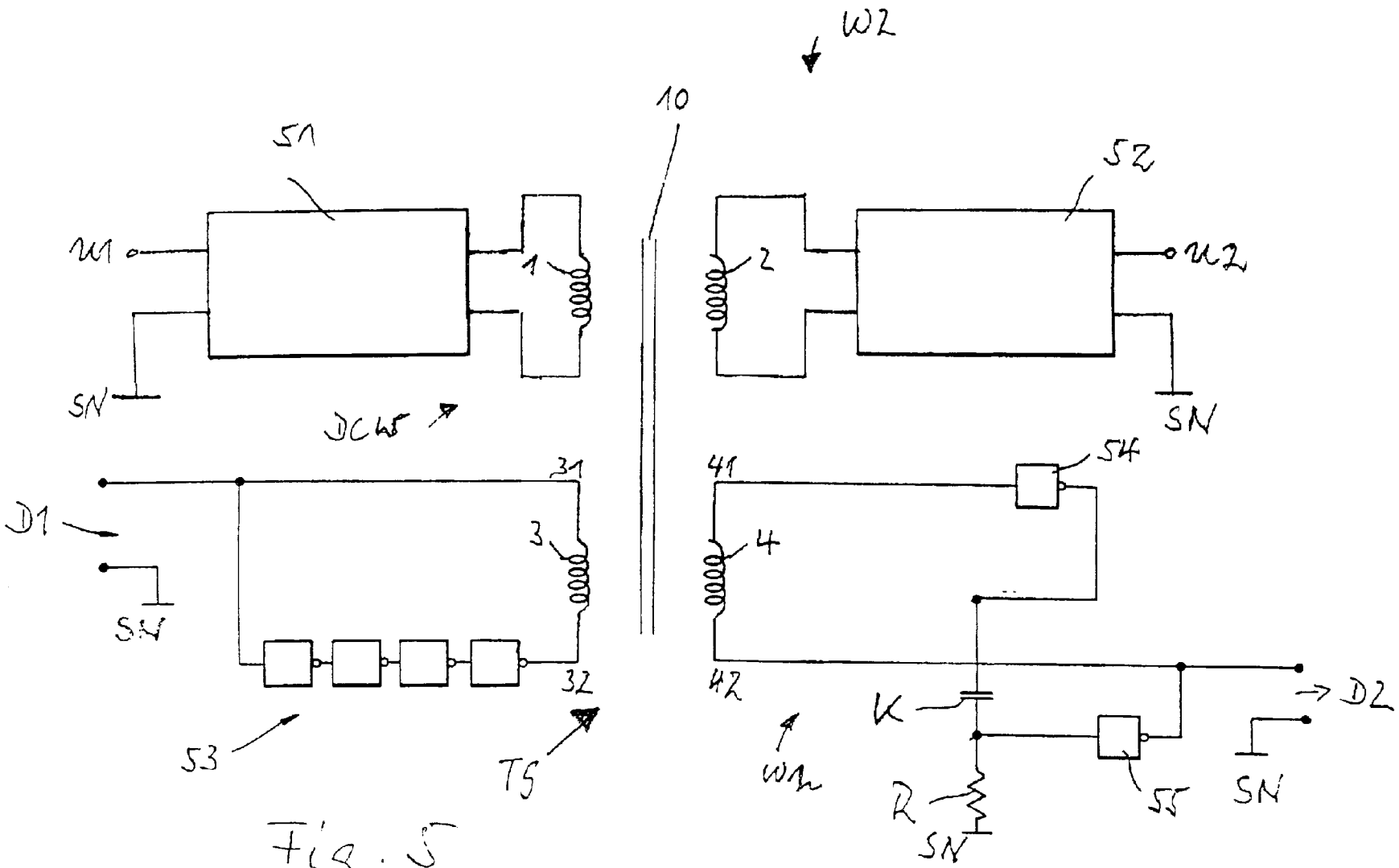
FIG. 5 shows schematically in block-diagram form a preferred use of a transformer as illustrated in FIGS. 1 to 4.

FIG. 5 shows schematically in block-diagram form a preferred use of a transformer as illustrated in FIGS. 1 to 4. The first coil and the second coil are, respectively, a primary coil and a secondary coil of a first AC power transmission path W1, and the third coil and the fourth coil are, respectively, a primary coil and a secondary coil of a second AC power transmission path W2. Preferably, the frequency of the first AC power is substantially less than the frequency of the second AC power.

That being presupposed, the first coil and the second coil are, respectively, a primary coil and a secondary coil of a DC/DC converter DCW, and the third coil and the fourth coil serve to accomplish the electrically separated transfer of digital signals as is described in EP-A 977 406, corresponding to U.S. patent application Ser. No. 09/354,689 of Jul. 16, 1999.

A primary circuit 51 of DC/DC converter DCW has one end connected to a first DC voltage to be converted, U1, and to circuit ground SN, and the other end is coupled to coil 1 of FIG. 1; the corresponding first coils of FIGS. 2 to 4 may also be chosen, of course. Since this choice also applies for the other coils, this is indicated in the following by the corresponding reference characters behind a dash.

A secondary circuit 52 of DC/DC converter DCW has one end connected to coil 2–2', 7, 7' and delivers at the other end a converted second DC voltage U2, which may be greater than, equal to, or less than DC voltage U1. Since the specific design of DC/DC converters has been in the prior art for a long time and may be quite varied, DC/DC converter DCW is shown as consisting only of subcircuits 51, 52 and coils 1, 2, etc. DC/DC converters usually oscillate at frequencies of 20 to 100 kHz.

The third coil 3–3', 8 is located on the primary side, and the fourth coil 4–4', 9, 9' on the secondary side, of a subcircuit TS for electrically separating digital signals as disclosed in the above-mentioned EP-A 977 406. A digital signal D1 is applied to terminal 31–31', 81, 81' of coil 3–3', 8. Connected to terminal 32–32', 82, 82' of coil 3–3', 8 is an output of a delay element 53, in this embodiment a series combination of four inverters.

Terminal 41–41', 91, 91' of coil 4–4', 9, 9' is connected to an input of an inverter 54, while terminal 42–42', 92, 92' of coil 4–4', 9, 9' is the output of the secondary of subcircuit TS, which provides a digital signal D2 that is virtually identical with, but electrically separated from, the digital signal D1.

An output of inverter 54 is connected to one terminal of a capacitor K, another terminal of which is grounded, SN, through a resistor R. The junction of capacitor K and resistor R is connected to an input of an inverter 55, whose output is coupled to terminal 42–42', 92, 92' of coil 4–4', 9, 9'. The two inverters 54, 55, capacitor K, and resistor R form a monostable multivibrator. For further details, reference is made to the above-mentioned EP-A 977 406.

Since digital signals are square-wave signals whose pulse repetition frequency is substantially greater than the frequency of DC/DC converters, the above-mentioned frequency condition can be easily satisfied.

The invention can be used to advantage with conventional physical-to-electrical transducers, such as transducers for pressure, level, temperature, flow rate—i.e., the fluid volume or fluid mass flowing through a given cross-sectional area per unit time—, or pH value, etc.

Such transducers generally have on-board evaluation electronics; the latter condition a signal from a physical-to-electrical transducer such that it conforms to a standard, e.g., to the conventional 4- to 20-mA current standard or to a frequency standard. "On-board" means that the evaluation electronics are located close to the physical-to-electrical transducer, i.e., in the transducer case.

In the case of such transducers, it is particularly advantageous if the third coil is connected to an external two-wire field bus, e.g., HART, FIELDBUS, PROFIBUS, etc., and the fourth coil interacts with a digital circuit of the on-board evaluation electronics, or vice versa.

What is claimed is:

1. An E-1 transformer, comprising:

a ferromagnetic E core, having a first and a second outer leg and an inner leg;

a ferromagnetic yoke in the form of a straight bar which is so arranged that it and said E core form a doubly closed magnetic circuit;

a first coil wound around said inner leg;

a second coil wound around said inner leg;

a third coil wound around said first outer leg; and a fourth coil wound around said first outer leg, wherein:

said first coil and said second coil are a primary coil and a secondary coil, respectively, of a first AC power transmission path; and said third coil and said fourth coil are a primary coil and a secondary coil, respectively, of a second Ac power transmission path.

2. The transformer as set forth in claim 1, wherein:

the frequency of the first AC power transmission path is substantially less than the frequency of the second AC power transmission path.

3. The transformer as set forth in claim 2, wherein:

said first coil and said second coil are, respectively, a primary coil and a secondary coil of a DC/DC converter; and said third coil and said fourth coil serve to accomplish an electrically separated transfer of digital signals.

4. Use of a transformer as set forth in claim 1, in a physical-to-electrical transducer with on-board evaluation electronics.

5. Use of a transformer as set o in claim 1, a physical-to-electrical transducer with on-board evaluation electronics, with said third coil having an external two-wire field bus connected thereto, and said fourth coil interacting with a digital circuit of the on-board evaluation electronics.

6. A transformer as set forth in claim 1, wherein:

said first coil is placed beside said second coil.

7. A transformer as set forth in claim 1, wherein:

said third coil is placed beside said fourth coil.

8. E-I transformer, comprising:

a first ferromagnetic E core, which has a first and a second outer leg and a first inner leg;

a second ferromagnetic E core, which is identical to said first E core, has a third and a fourth outer leg and a second inner leg, and is so arranged that it and said first E core forms a doubly closed magnetic circuit which has a first outer link, a second outer link, and an inner link;

a first coil, would around said inner link;

a second coil, wound around said inner link;

a third coil, wound around said first outer link; and a fourth coil, wound around said first outer link, wherein:

said first coil and said second coil are, respectively, a primary coil and a secondary coil of a second AC power transmission path.

9. The transformer as set forth in claim 8, wherein:

said first AC power is substantially less than the frequency of said second AC power.

10. The transformer as set forth in claim 9, wherein:

said first coil and said second coil are, respectively, a primary coil and a secondary coil of a DC/DC converter; and said third coil and said fourth coil serve to accomplish an electricaUy separated transfer of digital signals.

11. Use of a transformer as set forth in claim 10, in a physical-to-electrical transducer with on-board evaluation electronics, with said third coil having an external two-wire field bus connected thereto, and said fourth coil interacting with a digital circuit of the on-board evaluation electronics.

12. Use of a transformer as set forth in claim 8, in a physical-to-electrical transducer with on-board evaluation electronics.

13. The transformer as set forth in claim 8, wherein:

said first coil is placed beside said second coil.

14. The transformer as set forth in claim 8, wherein:

said third coil is placed beside said fourth coil.

15. An E-I transformer, comprising:

a ferromagnetic E core, having a first and a second outer leg and an inner leg;

a first coil, wound around said inner leg;

a second coil, wound around said inner leg;

a third coil, wound around said first outer leg;

a fourth coil, wound around said first outer leg; and a ferromagnetic yoke in the form of a straight bar which is so arranged that it and the E core form a double closed magnetic circuit, wherein:

said first coil and said second coil are, respectively, a primary coil and a secondary coil of a DC/DC converter, and wherein:

the third coil and the fourth coil serve to accomplish an electrically separated transfer of digital signals.

16. Use of a transformer as set forth in claim 15, wherein:

said first coil is placed beside said second coil.

17. Use of a transformer as set forth in claim 15, wherein:

said third coil is placed beside said fourth coil.

18. Use of a transformer as set forth in claim 15, in a physical-to-electrical transducer with on-board evaluation electronics, with said third coil having an external two-wire field bus connected thereto, and said fourth coil interacting with a digital circuit of the on-board evaluation electronics.

19. An E-I transformer, comprising:

a first ferromagnetic E core, which has a first and a second outer leg and a first inner leg;

a second ferromagnetic E core, which is identical to the first E core, has a third and a fourth outer leg and a second inner leg, and is so arranged that it and the first E core form a double closed magnetic circuit which has a first outer link, a second outer link, and an inner link;

a first coil, wound around the inner link;

a second coil, wound around the inner link;

a third coil, wound around the first outer link;

a fourth coil, wound around the first outer link, wherein:

said first coil and said second coil are, respectively, a primary coil and a secondary coil of a DC/DC converter; and said third coil and said fourth coil serve to accomplish an electrically separated transfer of digital signals.

20. Use of a transformer as set forth in claim 19, wherein:

said first coil is placed beside said second coil.

21. Use of a transformer as set forth in claim 19, wherein:

said third coil is placed beside said fourth coil.

22. Use of a transformer as set forth in claim 19, in a physical-to-electrical transducer with on-board evaluation electronics, with the third coil having an external two-wire field bus connected thereto, and the fourth coil interacting with a digital circuit of the on-board evaluation electronics.

* * * * *